United States Patent [19]

Romand et al.

[11] Patent Number: 4,776,579

[45] Date of Patent: Oct. 11, 1988

[54] AUTOMATIC GUIDANCE DEVICE FOR DEFORMABLE SHEET MATERIAL

[75] Inventors: Paul Romand, Bourg de Peage; Frederic Pescia, Portes-les-Valence, both of France

[73] Assignees: Societe Anonyme Dite "Anciens Ets Rene Aaron"; Arthur Paul Clement, both of Paris; Laurent Braquehais France, Levallois-Perret, all of France

[21] Appl. No.: 12,579

[22] Filed: Feb. 9, 1987

[30] Foreign Application Priority Data

Feb. 11, 1986 [FR] France ..... 86 02348

[51] Int. Cl.[4] ..... B65H 7/14; B26D 5/34

[52] U.S. Cl. ..... 271/228; 271/227; 112/121.12; 112/121.15; 112/308; 250/202; 901/6; 901/16; 901/47; 83/365

[58] Field of Search ..... 112/121.12, 121.15, 112/153, 308, 309, 311, 314, 318, 322, 121.11; 250/202, 461.1, 458.1; 271/227, 228, 250, 251, 261, 265; 901/6, 16, 17, 47; 83/365, 371, 367; 235/491; 51/165.72

[56] References Cited

U.S. PATENT DOCUMENTS

| | | | |
|---|---|---|---|
| 2,684,651 | 7/1954 | Bihaly | 112/121.12 X |
| 3,175,824 | 3/1965 | Albosta | 271/251 |
| 3,216,380 | 11/1965 | Bono | 112/121.12 |
| 3,417,718 | 12/1968 | Andersson | 112/153 |
| 3,472,187 | 10/1969 | Kaplan et al. | 112/153 X |
| 3,529,084 | 9/1970 | Rich | 382/60 X |
| 4,598,655 | 7/1986 | Takenoya | 112/121.12 X |

*Primary Examiner*—H. Grant Skaggs
*Assistant Examiner*—Stephen Parker
*Attorney, Agent, or Firm*—Herbert Dubno

[57] ABSTRACT

An apparatus for feeding a piece of sheet material to a tool utilizes a set of grippers on telescoping arms of a mean trajectory control system for displacing the sheet material in accordance with a predetermined trajectory. Local correction is effected by passing the piece of sheet material between two discs, one of which is rotatable about a horizontal axis but swingable about a vertical axis while the other, on the opposite side of the sheet, is rotatable about a vertical axis coincident with the first vertical axis. A line is marked on the sheet material with a substance stimulated by ultraviolet and emits a wavelength to which photodetectors are responsive to control the local correction device.

13 Claims, 3 Drawing Sheets

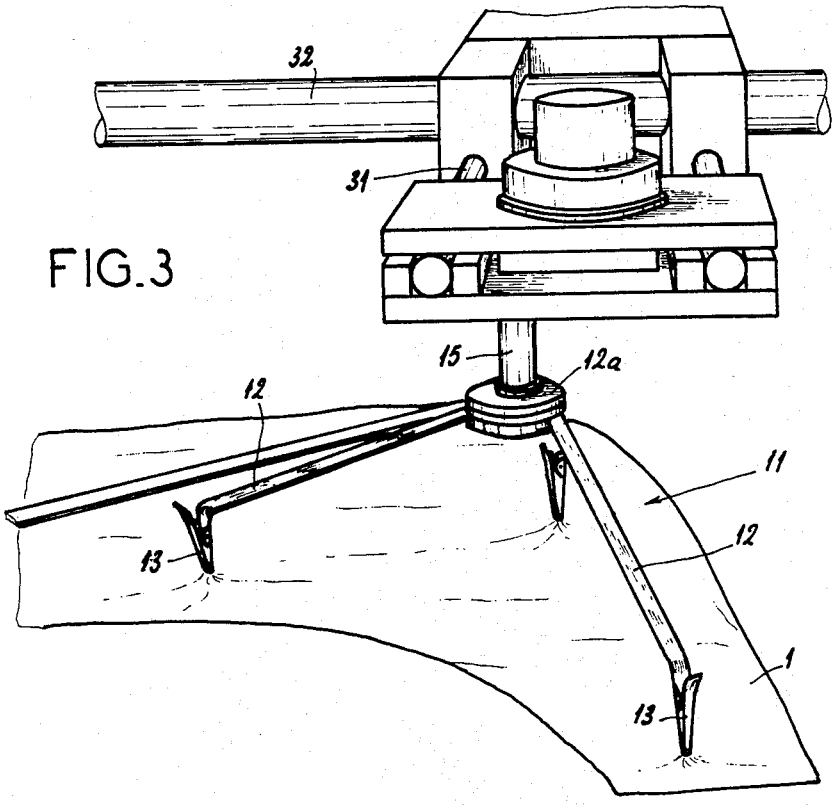
FIG. 3
FIG. 4
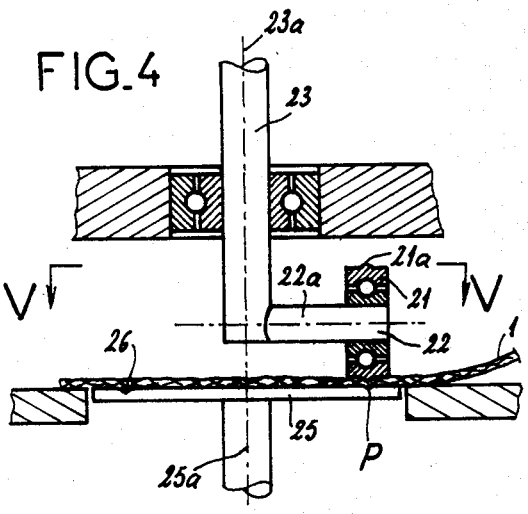
FIG. 5
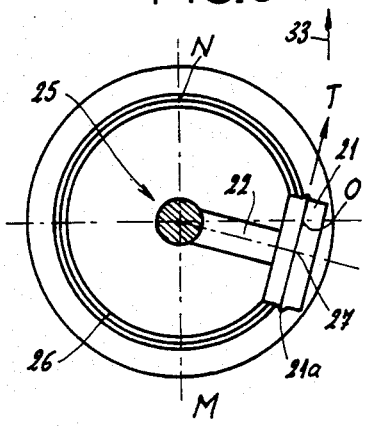

AUTOMATIC GUIDANCE DEVICE FOR DEFORMABLE SHEET MATERIAL

The present invention relates a device for automatic guidance of non-rigid, deformable materials such as plastics, textiles, leather, hide, etc.

This device is intended essentially to guide sheet materials in relation to an object of a similar nature, an object of a different nature, or a cutting, assembly or perforating tool, etc.

BACKGROUND OF THE INVENTION

In the case of rigid, non-deformable materials, guidance does not present any major problems and is often carried out on the basis of the outline of the objects. However, such a guidance method cannot be applied to those deformable materials whose outline is liable to move during execution.

OBJECT OF THE INVENTION

The object of the present invention is to overcome these inconveniences and provide a reliable automatic guiding device for deformable sheet materials, which ensures accurate guidance of such materials even when local deformation occurs during the guidance.

SUMMARY OF THE INVENTION

This objective is attained with a device for automatic guidance according to this invention which includes a material guiding device containing a system of prehension for this material and capable of moving this material according to a predetermined trajectory, and a device for local correction of the trajectory, capable of modifying the trajectory followed by the material if the latter deviates from its predetermined trajectory.

This device thus ensures perfect guidance of the sheet material, even when the latter becomes deformed.

Preferably the device for local trajectory correction includes a device for detecting deviation by the material from the predetermined trajectory, and a device which acts to correct the local trajectory of the material until realigned with the original course.

The detection device consists of detectors which are stimulated upon passing over a line marked beforehand on the material, the said line corresponding to the desired local trajectory of the material in relation to the tool.

The marked line can be formed by ink powder or varnish capable of emitting a luminous radiation of a given wavelength which can be detected by photodetectors when the marked line is stimulated by ultraviolet rays. Any other optical, magnetic or electrical marker may be used in the same manner with corresponding detectors.

The device for local trajectory correction of the material is formed by one or more discs with a horizontal axis in contact with the material, which can be orientated around an axis perpendicular to the plane of travel of the material. When the trajectory of the web deviates from the predetermined trajectory, that is, the tool deviates in relation to the line marked on the material, a modification takes place in the disc orientation, creating a new orientation of attack of the disk on the material which modifies the local trajectory of the web.

Preferably, the disc is mounted to rotate around its axis and can be motor driven and rides on a second disc with a vertical axis, coaxial with the rotation axis of the first disc, placed on the other side of the material and fitted with a circular groove the radius of which corresponds to the rotation radius of the first disc.

BRIEF DESCRIPTION OF THE DRAWING

The following description, referring to the accompanying drawing, will clarify the operation of the guiding device and show other characteristics. In the drawing:

FIG. 3 is a view similar to FIG. 2 of the general guidance device and the prehension system;

FIG. 4 is an axial section view of the device shown in FIG. 2;

FIG. 5 is a cross section taken along the line V—V of FIG. 4;

SPECIFIC DESCRIPTION

Figure 1:
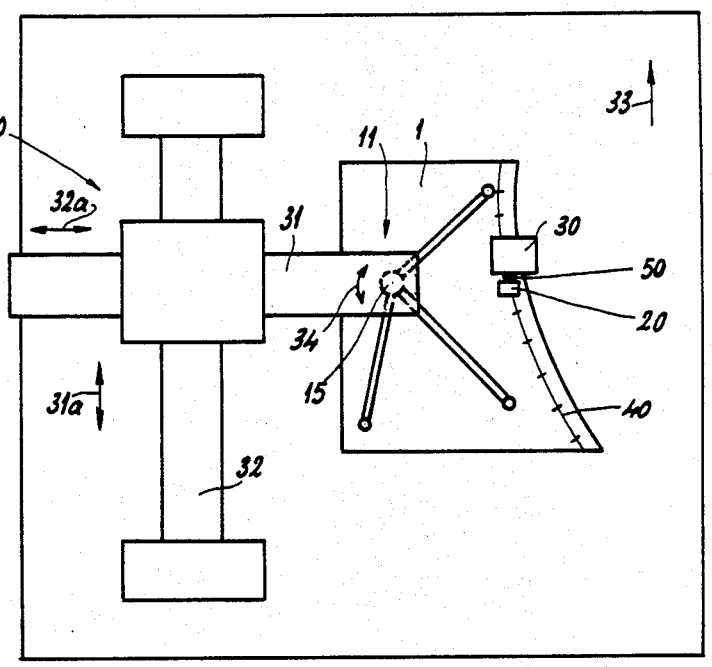
FIG. 1 is a diagrammatic plane view showing this automatic guidance device.

As shown in FIG. 1, the device for automatic guidance of sheet materials 1 as described in the invention is formed essentially by a guidance device 10 fitted with a system 11 for prehension of the sheet material 1 and with a device 20 for local correction of the trajectory of the material 1, this device 20 being situated in proximity to the work tool 30.

The guidance device 10 is mounted so that it can travel in a horizontal plane; that is, parallel to the traveling plane of the material as determined by the mutually perpendicular guides 31, 32, the directions of movement being shown by double arrows 31*a*, 32*a*. As shown by FIG. 1, the direction represented by arrow 31*a* is parallel to the feed direction (forward) (arrow 33 in FIG. 2) of the sheet material 1. The other direction of movement 32*a* is perpendicular to the forward direction 33 of the sheet material 1.

In addition, the prehension system 11 is mounted to rotate (arrow 34) about an axis 15 which is perpendicular to the horizontal movement of the sheet material 1 and therefore, is vertical.

The general guidance system 10 and its prehension system 11 are shown in greater detail in FIG. 3.

The prehension system 11 is formed by several (in this example, three) telescopic arms 12 which extend out from their common rotation axis 15.

Each arm 12 is fitted at its free extremity with a prehension element 13, which may consist of a clip as in FIG. 3, or of suction pad or magnetic system.

Each arm 12 is fixed by means of a mechanical release system 12*a* to the axis 15. The various arms 12 can be set at different angles in relation to one another and the prehension elements 13 can be moved radially to different distances from the axis 15.

Since these arms 12 are telescopic, it is evident that they can be very easily adapted to the configuration of the sheet material 1 which is to be controlled by the guidance device 10.

The various movements of the guidance device 10; that is, rotation of the prehension system 11 around the axis 15, and the movements according to axis 31 and 32 are obtained with fluid-operated elements and/or motors or similar systems, which have not been illustrated.

These movements are programmed and controlled in synchronization with the advance of the material, by a computer for example, so that the sheet material 1 follows a predetermined trajectory. This is calculated in such a way that the tangent to the curve traced by the sheet material is always parallel to the forward direction of the material. The curve traced by the material clearly corresponds to the desired local trajectory of the material in relation to the tool.

Figure 2:
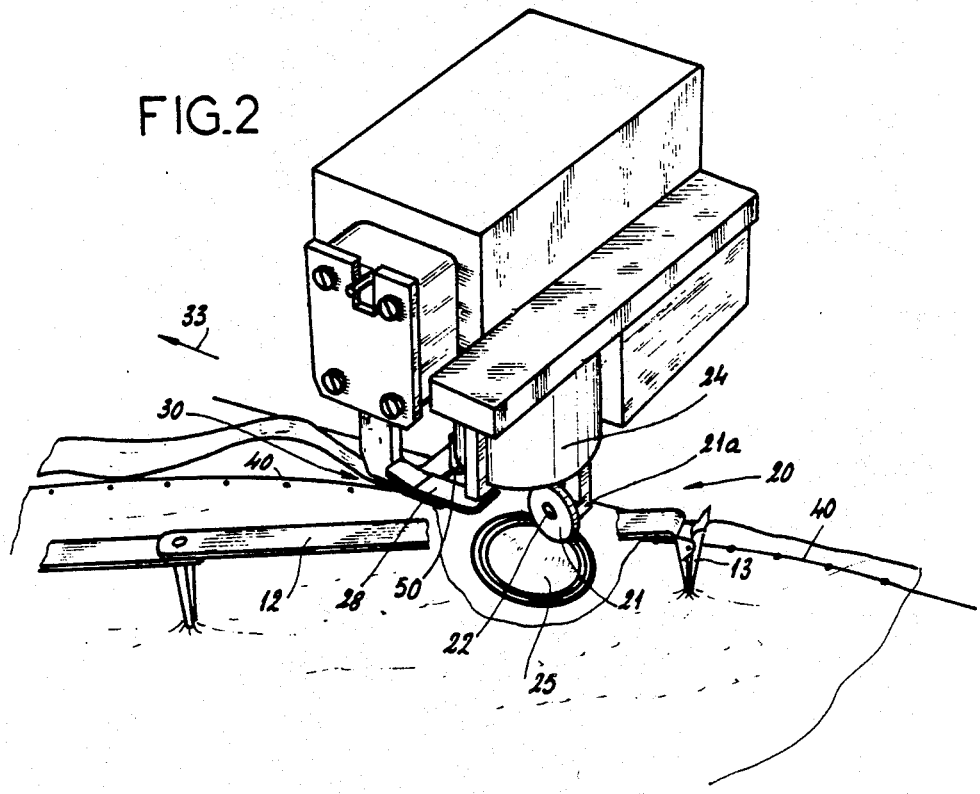
FIG. 2 is a perspective view on an enlarged scale of the device for local trajectory correction.

The local trajectory correction device 20 is shown in greater detail in FIGS. 2, 4 and 5. This correction device 20 consists essentially of a disc 21 which can be either mounted to rotate around a rod 22 on horizontal axis 22*a* as shown in FIG. 4, or motor driven the same axis, and of a disc 25 on vertical axis 25*a* and mounted at a tangent to disc 21. As shown in FIG. 2 this device is mounted upstream of the work tool 30 and the advance mechanism 28 holding the material 1, in relation to the forward direction 33.

Rod 22 is attached to rod 23 which extends along vertical axis 23*a*, this rod 23 being itself connected to the output shaft of a positioning motor 24. Consequently disc 21 is mounted to rotate, on one hand around the vertical axis (23*a*) offset in relation to median plane of this disk, and on the other hand around its own horizontal axis 22*a*.

In addition, the outside edge of this disc 21 is fitted with padding 21*a*, formed for example by a ring made of rubber or of another material with a high friction coefficient, or with a series of studs.

Disc 25 is itself mounted to rotate around its own axis 25*a*, which coincides with rotation axis 23*a*, for example with the aid of a ball bearing not shown on the diagram. This disc 25 has a radius at least as great as the rotation radius of disc 22 around axis 23*a*.

In addition it has a circular groove 26 on its upper surface designed to meet disc 21. This groove 26 is also centered the axis 25*a*, 23*a*; it has a transversal section corresponding to that of padding 21*a* fitted on disc 21, and is designed to accept the latter when disc 21 rotates around axis 23*a*.

In this way, when rod 23 turns, disc 21 turns on disc 25 by rolling along groove 26 of the latter.

When the sheet material 1 is placed between the two discs 21 and 25, the rotation of disc 21 in relation to the axis 23*a* will change its direction in relation to the forward direction 33 and thereby the trajectory followed by the material 1 at the point of contact P between the latter and the two discs 21 and 25, due to the change of tangent T of the trajectory at this point of contact P.

In effect, for any given orientation of disc 21 around axis 23, the point of contact P between this disc 21 and the material 1 causes a different orientation of the trajectory followed by the material.

Thus as a function of the angle of orientation of the combination of the rod 22 and disc 21 in relation to the driving or forward direction 33 of the material, the orientation given to the trajectory of this material will be modified.

Thus, if disc 21 remains parallel to the forward direction 33; that is, if rod 22 is perpendicular to the forward direction 33, the point of contact P between disc 21 and the material 1 will coincide with the point O, and the trajectory of the material will be rectilinear.

If (as seen in FIG. 5) disc 21 turns around axis 23 in such a way as to form an acute angle with the forward direction 33; that is, so that point of contact P is on the circular arc ON, then the change in trajectory imposed by disc 21 on the material 1 will be a concave circular arc, with its radius decreasing as P approaches N.

In contrast, if disc 21 turns in such a way as to form an obtuse angle with the forward direction 33; that is, so that point of contact P is on the circular arc OM, then the change in trajectory imposed on the material 1 will be convex.

Hence this device enables effective compensation of any deformations suffered by the material 1, and the conservation of the desired trajectory. In addition, it allows modification of the trajectory based on very slight curves and thereby achieves high accuracy in tracing the predetermined trajectory.

It is evident that the local orientation system must permanently generate a local trajectory corresponding to the desired local trajectory and thus that disc 21 will be maintained around a theoretical position corresponding to the predetermined trajectory at the point under consideration.

It is also evident that this guidance device could be arranged in a different manner. For example, disc 25 could be removed, as could the circular groove 26 and the protective padding 21*a* of disc 21.

However, it can be noted that disc 25 facilitates the operation of the whole unit. Likewise, groove 26 and padding 21*a* enable the elimination of any slipping effect between the material 1 and each of the two discs 21 and 25; such a slipping effect would obviously be detrimental to the overall operation of the unit.

Furthermore, disc 21 could be driven by a speed-controlled motor, or coupled with and driven by the forward speed of the material 1 along the axis 33. This could, if necessary, increase the efficiency of the local correction system.

Finally, disc 21 could also be placed at a non-perpendicular angle to the material 1.

Figure 6:
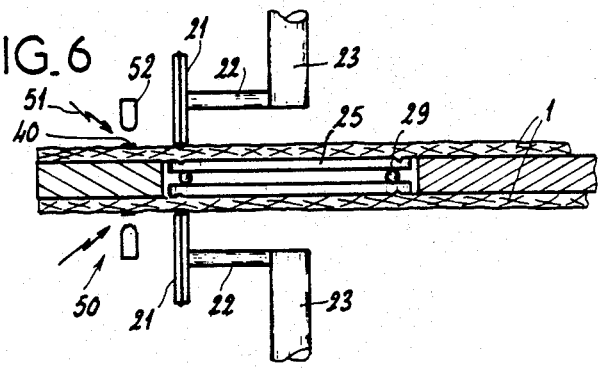
FIG. 6 is a view similar to FIG. 4 showing a different arrangement for two materials driven separately.

FIG. 6 shows the application of the local correction system 20 to the superimposition of two sheet materials 1. In this case, a local correction system 20; that is, a disc 21 rolling on a disc 25, is associated with each material 1, and the two discs 25 can then be formed by two ball-bearing rings 29. A motor couple (not seen in the drawing) can be associated with either of the two discs 25 so as to create a couple acting for or against the advance of either of the two materials 1, so as to contract or stretch this material 1 in relation to the other material and obtain perfect superimposition of the two.

Each local trajectory correction device 20 has an associated system of line marking 40 on the sheet material and of detection 50 of this marked line allowing the device 20 to change locally the trajectory of the material 1 when it deviates too far from the theoretical trajectory represented by marked lines 40.

Marked line 40 is traced on the material 1 itself and corresponds to the predetermined trajectory which is to be followed by the tool 30 on the material 1.

This marked line 40 is deposited by means of ink, powder or varnish which, when light-stimulated, emits a luminous radiation on a different wavelength to that of the light stimulation (in the example under consideration).

The ink chosen preferably is of a type commonly used in the textile industry which emits a high intensity red light when stimulated by ultraviolet light.

The detection system 50 associated with each marked line 40 includes an ultraviolet light source 51 capable of stimulating the marked line 40 deposited on the material 1, and photodetectors 52, 53, 54 and 55 capable of receiving the rays emitted by the ink which has been stimulated by the ultraviolet light source 51.

This detection system 50 is placed as close as possible to the tool and ahead of it in relation to the forward direction 33 of the material.

It is evident that a lens, a series of filters and a wave-guide (not shown) can be associated with light source 51 in order to obtain a convergent beam of the correct wavelength with a minimum loss of light.

The optional wave-guide for carrying the ultraviolet rays ensures the path of the beam generated at light source 51 to the chosen detection zone, allowing a non-rectilinear path as a function of the restrictions due to obstruction by the elements external to the detection system.

Figure 7:
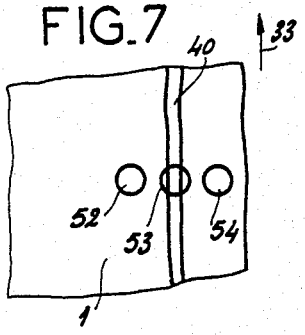
FIGS. 7 and 8 show different possible detector positions in relation to the marked line.
Figure 8:
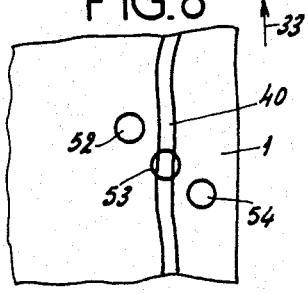

Each detection system 50 includes at least three photodetecters 52, 53, 54 which can be placed either at right angles to the forward direction 33 as shown in FIG. 7, or at a non-perpendicular angle to the forward direction 33 as shown in FIG. 8. This arrangement minimizes obstruction.

Correct positioning of the material 1 will therefore be detected when the centrally situated photodetector 53 is directly over the marked line 40 and is therefore stimulated by the latter.

If the material 1 deviates from its trajectory and for example detector 52 which is situated on the left in FIGS. 7 and 8 is stimulated, the motor controlling the orientation of disc 21 is activated so as to bring back the material 1 towards the right. This motor executes rotations at determined angles until the new orientations of disc 21 have resulted in the material 1 rejoining the predetermined trajectory. Conversely, if the righthand detector 54 is stimulated, the motor will turn the disc 21 so as to bring back the material 1 towards the left until it rejoins the theoretical trajectory. The local correction system 20 is thus controlled by the detection system 50.

A fourth photodetector 55 may also be included for the initialization of the marked line; that is, for locating the start of this marked line 40.

This initialization photodetector 55 is placed before the central photodetector 53 in the advance direction 33, and is in alignment with it.

FIGS. 10 to 13 illustrate the different stages of the initialization procedure of a marked line 40 when this procedure takes place in an angle 41 of the marked line 40.

Figure 10:
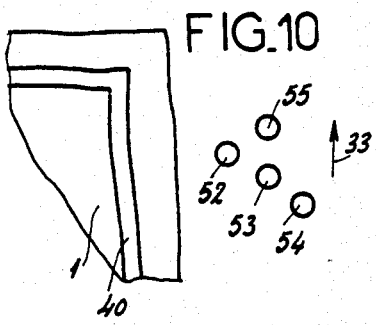
FIGS. 10 to 13 illustrate the different stages of initialization of a marked line at an angle of that marked line.
Figure 11:
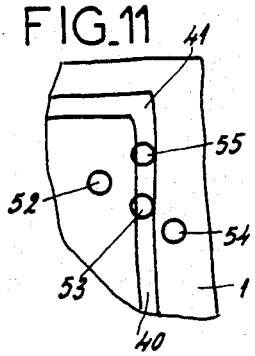
Figure 12:
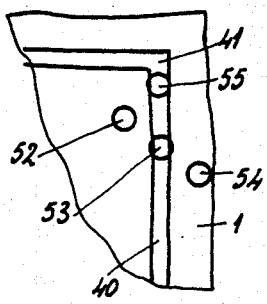

At the starting position the different detectors, and notably initialization detector 55, are situated outside the marked line 40 and are thus not stimulated by it (see FIG. 10).

The general transfer or guidance device 10 moves the sheet material 1 until the initialization detector 55 and the central detector 53 are stimulated (see FIG. 11); at this moment all detectors are aligned on the marked line 40, which itself is parallel to the forward direction 33.

Figure 13:
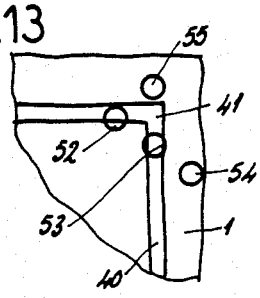

The general transfer device 10, optionally assisted by the local orientation system if the latter is motorized (motor couple associated with disc 21) then moves the sheet material 1 parallel to the marked line 40 (see FIG. 12) until the initialization detector 55 is no longer stimulated and is thus outside the marked line 40 (see FIG. 13). At this point the sheet material 1 is in the initialization position; that is, the detectors 52, 53, 54, 55 are above an angle 41 of the marked line and can begin to follow the trajectory.

Figure 9:
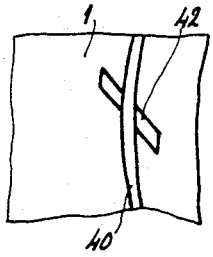
FIG. 9 shows a specific example of depositing the marked line.

As shown in FIG. 9, markers 42 can be placed at regular intervals along the marked line 40. These markers 42 are orientated in relation to the marked line in such a manner as to stimulate several photodetectors (three (52, 53, 54) in the case of FIG. 9) at the same time.

These markers 42 fulfil a "rendezvous" function and enable for example verification that the predetermined trajectory is being correctly followed, or differentiation of certain areas of that trajectory: these "rendezvous" may be particular points which must match up on two separately controlled materials (for example, for superimposition or assembly of sheets).

These regularly spaced markers can also be used to regulate the progress of material 1 under the tool should the material advance not be sufficiently reliable.

We claim:

1. A device for the automatic guidance of deformable sheet material, comprising:

main guiding means including:

a prehension system provided with grippers engaged with a piece of deformable sheet material to be guided and formed with a marked line deposited on said piece of sheet material corresponding to a local trajectory of said piece of sheet material relative to a tool, and means for moving said prehension system in accordance with a predetermined trajectory; and local trajectory correction means including means engageable with said piece of deformable sheet material proximal to said tool for locally correcting the trajectory of said piece of sheet material, and detection means for detecting deviation of said piece of sheet material from the predetermined trajectory and including a plurality of detectors stimulated upon being crossed by said marked line deposited on said piece of sheet material for controlling said means engageable with said piece of sheet material to effect local correction of said trajectory.

2. The device defined in claim 1 wherein said detectors are photodetectors and said marked line is a deposit of ink, powder or varnish stimulated by ultraviolet rays and emitting radiation of a predetermined wavelength, said photodetectors being responsive to said wavelength.

3. The device defined in claim 2 wherein three of said photodetectors are provided for said detector means and said photodetectors are located in a line which is nonparallel to a forward direction of advance of said piece of sheet material toward said tool.

4. The device defined in claim 3 wherein said detector means includes a fourth photodetector located in line with and ahead of a central one of said three photodetectors in said forward direction.

5. The device defined in claim 1 wherein said prehension system comprises:

a plurality of arms formed with respective ones of said grippers; and means mounting said arms to rotate about a substantially vertical axis.

6. The device defined in claim 1 wherein said marked line is provided with markers spaced therealong for signalling the velocity of said piece of material to coordinate said piece of material with another piece of material to be juxtaposed therewith.

7. A device for the automatic guidance of deformable sheet material, comprising:

main guiding means including:

a prehension system provided with grippers engaged with a piece of deformable sheet material to be guided and formed with a marked line deposited on said piece of sheet material corresponding to a local trajectory of said piece of sheet material relative to a tool, and means for moving said prehension system in accordance with a predetermined trajectory; and local trajectory correction means including means engageable with said piece of deformable sheet material proximal to said tool for locally correcting the trajectory of said piece of sheet material, and detection means for detecting deviation of said piece of sheet material from the predetermined trajectory for controlling said means engageable with said piece of sheet material to effect local correction of said trajectory, said means engageable with said piece of sheet material including:

a first disk rotatable about a generally horizontal axis and engaging said piece of sheet material from one side, means, controlled by said detection means, for swinging said first disk about a substantially vertical axis spaced from said first disk, and a generally horizontal second disk engaging said piece of sheet material from a side thereof opposite said one side and rotatable about a generally vertical axis substantially coincident with said vertical axis of the swing of said first disk, said second disk having a circular groove cooperating with the periphery of said first disk and on a face of said second disk turned toward said first disk and with a radius substantially equal to the distance of said periphery from said vertical axis of the swing of the first disk.

8. The device defined in claim 7 wherein said first disk is driven by a controlled-speed motor.

9. The device defined in claim 7 wherein said first disk is provided with friction means on said periphery limiting slip against said piece of material.

10. A device for the automatic guidance of deformable sheet material, comprising:

main guiding means including:

a prehension system provided with grippers engaged with a piece of deformable sheet material to be guided and formed with a marked line deposited on said piece of sheet material corresponding to a local trajectory of said piece of sheet material relative to a tool, and means for moving said prehension system in accordance with a predetermined trajectory; and local trajectory correction means including means engageable with said piece of deformable sheet material proximal to said tool for locally correcting the trajectory of said piece of sheet material, and detection means for detecting deviation of said piece of sheet material from the predetermined trajectory for controlling said means engageable with said piece of sheet material to effect local correction of said trajectory, said prehension system comprising:

a plurality of telescoping arms each being formed with a respective one of said grippers, and mounting means carrying said arms and rotatable about a substantially vertical axis perpendicular to a plane of said piece of sheet material.

11. The device defined in claim 10 wherein said means engageable with said piece of material includes:

a first disk rotatable about a generally horizontal axis and engaging said piece of sheet material from one side;

means, controlled by said detection means, for swinging said first disk about a substantially vertical axis spaced from said first disk; and a generally horizontal second disk engaging said piece of sheet material from a side thereof opposite said one side and rotatable about a generally vertical axis substantially coincident with said vertical axis of the swing of said first disk, said second disk having a circular groove cooperating with the periphery of said first disk and on a face of said second disk turned toward said first disk and with a radius substantially equal to the distance of said periphery from said vertical axis of the swing of the first disk.

12. The device defined in claim 11 wherein said detection means includes:

a plurality of detectors stimulated upon being crossed by said marked line deposited on said piece of sheet material for controlling said means engageable with said piece of sheet material to effect local correction of said trajectory.

13. The device defined in claim 12 wherein said detectors are photodetectors and said marked line is a deposit of ink, powder or varnish stimulated by ultraviolet rays and emitting radiation of a predetermined wavelength, said photodetectors being responsive to said wavelength.

* * * * *